US008147706B2

(12) United States Patent
Zeliff et al.

(10) Patent No.: US 8,147,706 B2
(45) Date of Patent: Apr. 3, 2012

(54) LOW TEMPERATURE FLAMELESS AEROSOL PRODUCING FIRE EXTINGUISHING COMPOSITION AND PRODUCTION METHOD THEREOF

(75) Inventors: Zachary Joseph Zeliff, Kerrville, TX (US); Liana Vladimirovna Loveless, Taipei (TW); Vladimir Victorovich Kutsel, Moscow (RU); Aleksander Ivanovich Doronichev, Moscow (RU)

(73) Assignee: ATOZ Design Labs Co., Limited, Hong Kong (HK)

( * ) Notice: Subject to any disclaimer, the term of this patent is extended or adjusted under 35 U.S.C. 154(b) by 0 days.

(21) Appl. No.: 12/777,063

(22) Filed: May 10, 2010

(65) Prior Publication Data

US 2010/0294975 A1 Nov. 25, 2010

(30) Foreign Application Priority Data

May 25, 2009 (RU) ..... 2009119565

(51) Int. Cl.

| | |
|---|---|
| ***A62D 1/06*** | (2006.01) |
| ***A62D 1/00*** | (2006.01) |
| ***C06B 31/06*** | (2006.01) |
| ***C06B 45/08*** | (2006.01) |
| ***C06B 45/18*** | (2006.01) |
| ***C06B 45/32*** | (2006.01) |
| ***A62C 3/00*** | (2006.01) |

(52) U.S. Cl. ..... 252/4; 252/5; 252/6; 252/7; 149/61; 149/62; 149/63; 149/64; 149/19.1; 149/19.7; 149/19.8; 169/46; 169/47

(58) Field of Classification Search ..... 252/4, 5, 252/6, 7; 149/61, 62, 63, 64, 19.1, 19.7, 149/19.8

See application file for complete search history.

(56) References Cited

U.S. PATENT DOCUMENTS

| | | | | |
|---|---|---|---|---|
| 2,179,434 | A * | 11/1939 | Simon | 149/63 |
| 3,361,603 | A * | 1/1968 | Griffith | 149/38 |
| 3,438,823 | A * | 4/1969 | Berthmann et al. | 149/53 |
| 3,679,189 | A * | 7/1972 | Deal et al. | 432/225 |
| 3,715,984 | A * | 2/1973 | Murray | 60/256 |
| 4,020,850 | A * | 5/1977 | Cogbill, II | 131/334 |
| 5,403,035 | A * | 4/1995 | Hamilton | 280/736 |
| 5,540,517 | A * | 7/1996 | Varosh | 404/12 |
| 5,552,001 | A * | 9/1996 | Fearon | 149/77 |
| 6,578,584 | B1 * | 6/2003 | Beven et al. | 131/365 |
| 2003/0051630 | A1 * | 3/2003 | Katsuda et al. | 102/531 |
| 2005/0127324 | A1 * | 6/2005 | Wu | 252/181.3 |
| 2007/0272288 | A1 * | 11/2007 | Brebner | 135/33.5 |

* cited by examiner

*Primary Examiner* — Joseph D Anthony

(57) ABSTRACT

A low temperature flameless aerosol producing fire extinguishing composition containing potassium nitrate and binding fuel is characterized by using cellulose-fibrous mass as a binding fuel, with potassium nitrate at 30-70% and fibrous cellulose mass making up the remainder. A production method for the composition is further provided.

14 Claims, 2 Drawing Sheets

| Fuel type | Elements, % of total mass | | | Q, kcal/kg | $O_2$ balance |
|---|---|---|---|---|---|
| | C | H | O | | α |
| Coal | 100 | 0 | 0 | 8100 | 0 |
| Phenol-formaldehyde Resin (Iditol) | 74.4 | 5.8 | 19.8 | 6938 | 0.081 |
| Epoxy resin ED-20 | 71.0 | 7.9 | 21.1 | 7146 | 0.083 |
| Polyvinyl Butyral | 67.6 | 9.9 | 22.5 | 7326 | 0.087 |
| Phenolphthalein | 75.5 | 4.4 | 20.1 | 6675 | 0.085 |
| Hydroquinone | 65.4 | 5.5 | 29.1 | 5894 | 0.133 |
| Salicylic acid | 60.9 | 4.3 | 34.8 | 5086 | 0.176 |
| Starch | 44.4 | 6.2 | 49.4 | 3837 | 0.294 |
| Cellulose | 44.4 | 6.2 | 49.4 | 3837 | 0.294 |

Figure 1.

| Fuel type | Elements, % of total mass | | | Q, kcal/kg | $O_2$ balance |
|---|---|---|---|---|---|
| | C | H | O | | α |
| Coal | 100 | 0 | 0 | 8100 | 0 |
| Phenol-formaldehyde Resin (Iditol) | 74.4 | 5.8 | 19.8 | 6938 | 0.081 |
| Epoxy resin ED-20 | 71.0 | 7.9 | 21.1 | 7146 | 0.083 |
| Polyvinyl Butyral | 67.6 | 9.9 | 22.5 | 7326 | 0.087 |
| Phenolphthalein | 75.5 | 4.4 | 20.1 | 6675 | 0.085 |
| Hydroquinone | 65.4 | 5.5 | 29.1 | 5894 | 0.133 |
| Salicylic acid | 60.9 | 4.3 | 34.8 | 5086 | 0.176 |
| Starch | 44.4 | 6.2 | 49.4 | 3837 | 0.294 |
| Cellulose | 44.4 | 6.2 | 49.4 | 3837 | 0.294 |

Figure 2.

| Parameters | Test results for samples | | | | | | | | |
|---|---|---|---|---|---|---|---|---|---|
| | #1 | #2 | #3 | #4 | #5 | #6 | #7 | #8 | #9 |
| Chemical composition,% | | | | | | | | | |
| Potassium nitrate | 30 | 40 | 50 | 50 | 60 | 60 | 45 | 45 | 70 |
| Cellulose -paper | 70 | 60 | 50 | - | 40 | - | 50 | - | 30 |
| Cellulose -cloth | - | - | - | 50 | - | 40 | - | 50 | - |
| Copper nitrate | - | - | - | - | - | - | 5 | - | - |
| Iron (III) nitrate | - | - | - | - | - | - | - | 5 | - |
| Oxygen balance α | 0.41 | 0.48 | 0.57 | 0.57 | 0.75 | 0.75 | 0.60 | 0.60 | 0.99 |
| Density, gram/cubic cm | 1.15 | - | 1.45 | - | 1.50 | - | 1.50 | - | 1.55 |
| Speed of combustion mm/sec | 0.45 | 0.50 | 1.85 | 0.80 | 0.65 | 0.50 | 2.25 | 1.00 | - |
| Surface temperature, °C | 550-600 | 600-650 | 600-650 | 600-650 | 650-700 | 650-700 | 650-700 | 600-650 | 1000-1100 |
| Burning character | Not stable | stable | stable | stable | stable | stable | stable | stable | Not stable |
| Presence of flame | no | no | no | no | no | no | no | no | Separate flames |
| Fire-extinguishing concentration gram/cubic meter | 66 | 60 | 53 | 58 | 30 | 43 | 35 | 45 | 65 |
| Appearance and quantity of remains, % of mass | Loose ash 25 | ash 30 | ash 25 | ash 30 | ash 20 | ash 25 | ash 15 | ash 20 | Fused slag 40 |
| Sample type | tablet | roll | tablet | roll | tablet | roll | tablet | roll | tablet |

LOW TEMPERATURE FLAMELESS AEROSOL PRODUCING FIRE EXTINGUISHING COMPOSITION AND PRODUCTION METHOD THEREOF

BACKGROUND OF THE INVENTION

1. Field of the Disclosure

The disclosure relates to fire fighting in general, and, specifically, to a fire-extinguishing aerosol applicable in closed spaces.

2. Description of the Related Art

Fire-extinguishing aerosol is often generated as a by-product of combustion of specifically formulated substances containing potassium nitrates and/or perchlorates as an oxidizer and supplier of the main fire-extinguishing agent. As a binding fuel it uses plasticized and non-plasticized polymers, capable of transitioning to viscous or flexible state under the influence of thermal or/and mechanical nature. Among well known and widely used binding fuels, phenol-formaldehyde and epoxy resins, polyvinyl butyral, cellulose ethers, rubber are worth mentioning.

The main component of the fire extinguishing aerosol is super fine (0.5 to 5 m) particles of potassium compound formed by the chemical reaction between oxidizer and fuel and dispersed by the gaseous reaction products.

Fire extinguishing effectiveness of such aerosol is dependent on quantity and individual size of potassium compound particles, which itself depends on temperature and degree of completion of chemical reactions between oxidizer and fuel. In turn, combustion temperature of the composition directly depends on temperature of binding fuel combustion. D. I. Mendeleev formulated a calculation of estimated heat of combustion for solid and liquid fuels as:

$$Q=81C+300H-26(O—S)-6(9H+W),$$

Where C, H, O, S and W—in the working mass of the fuel, are the presence of carbon, hydrogen, oxygen, sulfur, with moisture expressed in percentage of the mass and heat expressed in kcal/kg.

Results of the calculations for the heat of combustion for the variety of fuels and binding fuels are shown in FIG. 1.

The heat of combustion of the binding fuel determines the temperature of the produced aerosol. Practically, the value cannot exceed several critical points that determine the fire extinguisher's safety within the environment.

To lower the temperature of the fire extinguishing aerosol, existing methods add fire extinguishing cooling components such as ditsiandiamid, melema, melamine and others (patent RU 2095104, C1, 10.11.97), and/or utilize (in manufacture of the fire extinguishing aerosol generator) special cooling elements in the form of granules, tubes, monoblocks, or other components. (patent RU 2064305, C1, 27.07.96). Both methods reduce fire-extinguishing effectiveness of the aerosol by half or more compared to un-cooled aerosol, while increasing toxic products of the produced aerosol due to the increase in carbon monoxide, which does not oxidize in the air.

A significant development is an aerosol producing compound for fire fighting (patent RU 2160619, class A62D 1/06, from 20.12.2000), containing potassium nitrate 65-75%, binding fuel 0-5%, ditsiandiamid 10-20% and additional fuel that makes up the remainder of percentage, capable of burning along with potassium nitrate. In short, traditional binding fuel (phenol-formaldehyde resins or iditol) is replaced with another fuel (starch, hydroquinone, phenolphthalein, salicylic acid amide or similar) presumably to combat super heated particles. This method, in addition to producing high temperature aerosol, is limited in use.

In another known composition and production method thereof, the oxidizer undergoes dangerous and labor-intensive comminution wherein binding fuel is dissolved in the toxic methylene chloride to ensure even distribution components in the mixture (patent RU 2185865, class A62D 1/00, 27.07.2002).

Another closely related production method involves mixing components in 30-35% aqueous dispersion of polyvinyl (patent RU 2005517, class A62D 1/00, 15.01.94), but in this case, the oxidizer is insufficiently comminuted and persists in suspension in water.

Thus, what is called for is a solution addressing the described limitations.

BRIEF DESCRIPTION OF THE DRAWINGS

The invention can be more fully understood by reading the subsequent detailed description and examples with references made to the accompanying drawing, wherein:

FIG. 1 lists results of calculating combustion heat of the various known fuels, including binding fuels.

FIG. 2 lists characteristics of the composition as disclosed.

DETAILED DESCRIPTION OF THE INVENTION

The disclosure provides a composition and production method thereof that is safe and not labor-intensive while allowing its components to be thoroughly mixed.

A substance is provided in which binding fuel exhibits a low combustion heat and relatively high oxygen concentration (high oxygen alpha balance), transforming the burning process to a flameless mode while retaining desired fire extinguishing properties and acceptable carbon monoxide levels. Furthermore, another technical result of the method as disclosed is increased variety of methods of processing material, of an aerosol producing substance, due to the use of cellulose-paper material, specifically such technologies such as forge rolling, flat rolling or form pressing.

The solution to the aforementioned problem and achievement of the desired technical result is accomplished by implementation of the provided low temperature flameless aerosol producing fire extinguishing composition as well as the production method thereof.

A low temperature flameless aerosol producing fire extinguishing composition is disclosed, containing potassium nitrate and binding fuel, characterized by the presence of cellulose fibrous mass, with the percentage of mass of: potassium nitrate—from 30-70%, with cellulose fibrous mass making up the remainder.

Preferably, this composition contains paper or cotton fabric as a cellulose fibrous mass.

Preferably, this composition contains water soluble copper nitrate and/or iron (III) nitrate.

A method of manufacturing low temperature flameless aerosol producing fire extinguishing composition as disclosed includes soaking cellulose fibrous mass in hot saturated water solution of potassium nitrate and subsequently dehydrating it to 40-60% moisture content, followed by hot air drying to 1-2% moisture content.

Preferably, the received material is then formed to a desired size and shape.

Preferably, formation of the product is accomplished by rolling that already dried by forced hot air to 1-2% moisture content into rolls of desired diameter.

Preferably, formation of the product is accomplished through form pressing on hydraulic press with a matrix heated to 90-95° C., using 30-150 Mpa pressure, followed by drying to 1-2% moisture content.

Preferably, formation of the product is accomplished through usage of rolls heated to 80-100° C. with either smooth or ribbed surface, by gathering a "sock" formed of the material that is periodically cut, removed from the tool and rolled to a needed diameter.

The method as disclosed includes adding a combustion catalyst of copper nitrate and/or iron(III) nitrate while soaking the cellulose fibrous mass in potassium nitrate solution.

The method as disclosed further includes hydrophobing by covering dried and/or formed to needed size and shape products with 1-2% moisture content with a thin film of lacquer 50-80 m thick.

Preferably, nitrocellulose (commonly used for furniture finish) or epoxy lacquer is used as a hydrophobing agent for surface treatment of the products.

In the combustion process of the suggested composition, cellulose is thermally decomposed, forming a soot skeleton, which activates decomposition of potassium nitrate. Because thermal decomposition of cellulose consumes a relatively large amount of heat but the heat of its combustion is relatively small, the combustion of the suggested composition produces no flame and the products of the combustion are not significantly heated. This presents an opportunity to significantly lighten and simplify the construction of the fire extinguishing aerosol generators as there remains no need for heavy and bulky aerosol coolant.

The molecular structure of cellulose contains oxygen up to 50% of its mass, which allows significantly increased oxygen alpha balance of the composition to 0.7-0.9. This reduces toxic carbon monoxide presence in combustion products to reasonable levels. This reduction is also aided by using combustion catalysts, such as water soluble copper and iron nitrates.

Use of catalysts increases linear speed of the combustion of the composition by 20-25%.

Testing of fire extinguishing properties of the disclosed composition was conducted in a clear and hermetically sealed 9 liter container.

For this purpose, a spirit lamp filled with gasoline was ignited inside the container, then a specified amount of the substance in the form of a "tablet" or twisted fabric was introduced. The free burning time of the spirit lamp in the sealed container without interference was a little over 3 minutes. The result of the experiment was considered favorable if the fire was extinguished within 40-60 seconds after the substance was ignited. Fire extinguishing concentration was determined as a result of dividing starting weight of the tablet or cloth by volume of the container.

The temperature on the surface of the tested sample was measured by a thermocouple. Results of the evaluation of the suggested composition's properties are listed in FIG. 2.

As mentioned, fire extinguishing effectiveness of the aerosol is dependent on temperature as well as completion of the chemical reactions during the combustion. Completion of the chemical reactions also determines degree of aerosol pollution with hot coal particles and concentration of carbon monoxide. The degree of completion of the chemical reactions in mixtures of solid matter is dependent on contact surface of the particles, i.e. the smaller the reacting particles are and the more evenly they are mixed in the composition, the higher is the degree of completion of the chemical reactions, while other variables remain constant. This is a very important technological aspect of manufacturing aerosol producing compositions.

In the disclosed manufacturing method, cellulose fibrous material is combined with potassium nitrate by means of soaking the material in the hot saturated solution of the latter, which contributes to the even distribution of the components through cellulose absorbing potassium nitrate from the solution, thus providing a safe manufacturing process for the suggested composition.

The duration of the swelling process of the cellulose fibrous material in the hot, saturated solution of the potassium nitrate is 7-10 minutes, and is finished with preliminary dehydration to 40-60% moisture content.

The processing of the cellulose fibrous material continues by further dehydration to reach 1-2%; for example, by blowing hot air heated to 95-105° C. and winding it into rolls of needed diameter.

An additional technical result provided by the method disclosed is an increased variety of methods of further processing the aerosol producing mass due to utilization of a cellulose fibrous material, specifically the ability to use separately forge rolling, flat rolling and form pressing.

This is possible because to produce paper, fibers of wood cellulose are ground into shorter and thinner fibers yet possessing higher degree of asymmetry (relationship between length and cross-section) than the original fibers. Along with splitting the fibers, there is also destruction and amorphization of the original structure that takes place. This combination gives surface layers higher degree of plasticity. The process to produce strong paper web from damp and elastic paper pulp lies in changing of the intermolecular relations by replacing capillary forces (surface tension) with intermolecular attraction forces between cellulose chains as water is removed from the mass. During secondary swelling of the cellulose in the water, the intermolecular connections of the cellulose chains are lessened, the glass transition temperature is lower and it gains plasticity, i.e. ability to flow with little force applied (Pankov. S. P Fiberous polymer materials. M: Himiya, 1986.)

The hot and damp cellulose-paper mass with absorbed potassium nitrate was pressed on a hydraulic press with heated matrix at applied pressure measured from 30 to 150 Mpa. Diameter and the moisture content of the pressed tablets were 10-35 mm and 8-10% of the mass. Tablets were dried further with hot air to reach 1-2% moisture content.

Hot and damp paper cellulose mass with potassium nitrate was flat rolled on smooth and ribbed (length wise) rolls that were heated to 80-100° C., after gathering the "sock" on the assisting roll and reducing humidity to 1-2%, and rolls were stopped from spinning, the sock was cut, removed and wound to the needed diameter.

As a finishing touch for the products from the composition, they can be treated with a hydrophobic surface layer of the specified lacquer, thickness of the dry film 50-80 m.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A low temperature flameless aerosol producing fire-extinguishing composition comprising:

water-soluble potassium nitrate; and a binding fuel comprising a cellulose-fibrous mass;

wherein the composition is formed by soaking the cellulose-fibrous mass in a solution of water and the potassium nitrate and then drying the composition to 1-2% moisture content; and wherein the potassium nitrate and cellulose-fibrous mass are present in the following mass percentage:

potassium nitrate from 30-70%, cellulose-fibrous mass remainder.

2. The composition of claim 1, wherein the cellulose-fibrous mass comprises paper.

3. The composition of claim 1, wherein the cellulose-fibrous mass comprises cotton cloth.

4. A production method for the low temperature flameless aerosol producing composition of claim 1, comprising the steps of:

soaking the cellulose fibrous mass in a hot saturated water solution of potassium nitrate;

removal of excess water to 40-60% moisture content; and drying to 1-2% moisture content.

5. The production method of claim 4, further comprising the step of forming the composition to a product having a desired size and shape.

6. The production method of claim 5, wherein the forming step comprises winding sheets previously dried by forced hot air to 1-2% moisture content into rolls of required diameter.

7. The production method of claim 5, wherein the forming step comprises form pressing, using a hydraulic press with a matrix heated to 90-95° C. and applying 30-150 Mpa pressure, followed by the step of drying the product to 1-2% moisture content.

8. The production method of claim 5, wherein the forming step comprises using smooth or ribbed rolls heated to 80-100° C. to gather and dry to 1-2% moisture content a sock that is periodically cut, removed from the tool and then wound into rolls of required diameter.

9. The production method of claim 5 further comprising the step of treating the surface of the product with a hydrophobing agent.

10. The production method of claim 9, wherein the hydrophobing agent comprises nitrocellulose or epoxy lacquer.

11. The production method of claim 9, wherein the hydrophobing agent comprises dry film lacquer with a thickness of 50-80 micron.

12. A low temperature flameless aerosol producing fire-extinguishing composition comprising:

water-soluble potassium nitrate;

water-soluble copper and/or iron (III) nitrates as combustion catalysts; and a binding fuel comprising a cellulose-fibrous mass;

wherein the composition is formed by soaking the cellulose-fibrous mass in a solution of water, the potassium nitrate and copper and/or iron (III) nitrates, and then drying the composition 1-2% moisture content; and wherein the potassium nitrate and cellulose-fibrous mass are present in the following mass percentage:

potassium nitrate from 30-70%, water soluble copper and/or iron (III) nitrates and cellulose-fibrous mass remainder.

13. The composition of claim 12, wherein the cellulose-fibrous mass comprises paper.

14. The composition of claim 12, wherein the cellulose-fibrous mass comprises cotton cloth.

* * * * *